US006892772B1

(12) United States Patent
Wang et al.

(10) Patent No.: US 6,892,772 B1
(45) Date of Patent: May 17, 2005

(54) ROTATING INFLATABLE DEVICE WITH BUILT-IN BLOWER AND SENSOR LIGHT

(76) Inventors: Hua-Chiang Wang, No. 2342, Sloan Dr., La Verne, CA (US) 91750; Hsin-Yen Lin, No. 11, Chuang Jou Road, Houli Hsiang, Taichung Hsien (TW), 421

( * ) Notice: Subject to any disclaimer, the term of this patent is extended or adjusted under 35 U.S.C. 154(b) by 0 days.

(21) Appl. No.: 10/770,417

(22) Filed: Feb. 4, 2004

(51) Int. Cl.[7] ..... B65B 1/04

(52) U.S. Cl. ..... 141/313; 141/94; 141/114; 141/268; 141/383; 141/386; 446/220

(58) Field of Search ..... 141/34, 37, 94, 141/114, 192, 197, 250, 267, 268, 279, 311 R, 313, 382, 383, 386, 391; 53/79, 403; 446/220, 226

(56) References Cited

U.S. PATENT DOCUMENTS 6,371,638 B1 * 4/2002 Zingale et al. ..... 362/565

* cited by examiner

*Primary Examiner*—Timothy L. Maust
(74) *Attorney, Agent, or Firm*—Bacon & Thomas PLLC

(57) ABSTRACT

A rotating inflatable device includes a base having an outlet a top thereof and an inlet in a side of the base. A blower is received in the base and driven by a motor. A drive part is received in the base and includes a rotating rod which is driven by another motor via a speed reduction unit. A drum to which a lower opening is mounted includes an annular ring and a central part which is located at a center of the drum by a plurality of ribs connected between the annular ring and the central part. A top end of the rotating rod is co-axially connected to the central part. A central shaft composed of a plurality of sections has its a lower end connected to the central part. A top end of the central shaft extends through a top opening of the balloon and is connected to a plate which seals on the top opening of the balloon.

10 Claims, 6 Drawing Sheets

ROTATING INFLATABLE DEVICE WITH BUILT-IN BLOWER AND SENSOR LIGHT

FIELD OF THE INVENTION

The present invention relates to a rotating inflatable device with a built-in blower in a box and the central shaft of the inflatable device is directly connected to the output shaft of the blower so that the inflatable device may rotate in stable condition.

BACKGROUND OF THE INVENTION

A conventional rotating balloon apparatus is disclosed in U.S. Pat. No. 6,167,924 and generally includes a blower which is connected to a duct so as to provide air into a base on which the balloon is installed. There are three sets of rotating wheels driven by a motor so as to rotate the lower rotator plate. The bottom of the balloon is secured by the upper and lower rotator plates, and the top of the balloon is positioned by the upper and lower top plates. A mast unit extends through the balloon and is connected to the rotator plates and the top plates so that when the motor rotates, the balloon can be rotated together with the plates. Nevertheless, the duct and the blower are exposed so that they tend to be damaged. The exposed duct makes the whole assembly to be difficult to be carried and/or transported. The drive wheel and the two idle wheels are exposed so that they could hurt the children playing around the device and dust or even pebbles may enter the gaps between these parts. Only the drive wheel generates driving force so that the base are applied the force at one side and may have problem of balance. Some parts of the mast unit are stationary during the operation of the rotating balloon and some are rotated such that friction between these rotating parts and stationary parts results in noise and resistance.

The present invention intends to provide a rotating inflatable device with a built-in blower and motor. The central shaft in the balloon is connected to the output shaft of the motor directly so that the central shaft is co-rotated with the balloon. By the invention, the shortcomings of the rotating balloon disclosed above are improved.

SUMMARY OF THE INVENTION

The present invention relates to a rotating inflatable device which comprises a base with an outlet in a top thereof and an inlet in a side of the base. A blower is received in the base and is driven by the first motor so as to blow air via the outlet. A drive part is received in the base and includes a frame through which a a rotating rod rotatably extends which is driven by a second motor connected to the frame. An output shaft of the second motor is connected to a speed reduction unit located at an underside of the frame. A drum includes an annular ring and a central part which located at a center of the drum by a plurality of ribs connected between the annular ring and the central part. A top end of the rotating rod is co-axially connected to the central part. A balloon has a lower opening thereof mounted to the drum. A central shaft composed of a plurality of sections has its lower end connected to the central part. A top end of the central shaft extends through a top opening of the balloon and is connected to a plate which seals on the top opening of the balloon.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 4 shows two limitation members limit the angle of the swinging of the two pedal assemblies;

FIG. 5 shows the light bulb provides illumination to the balloon; and

DETAILED DESCRIPTION OF THE PREFERRED EMBODIMENT

Figure 1:
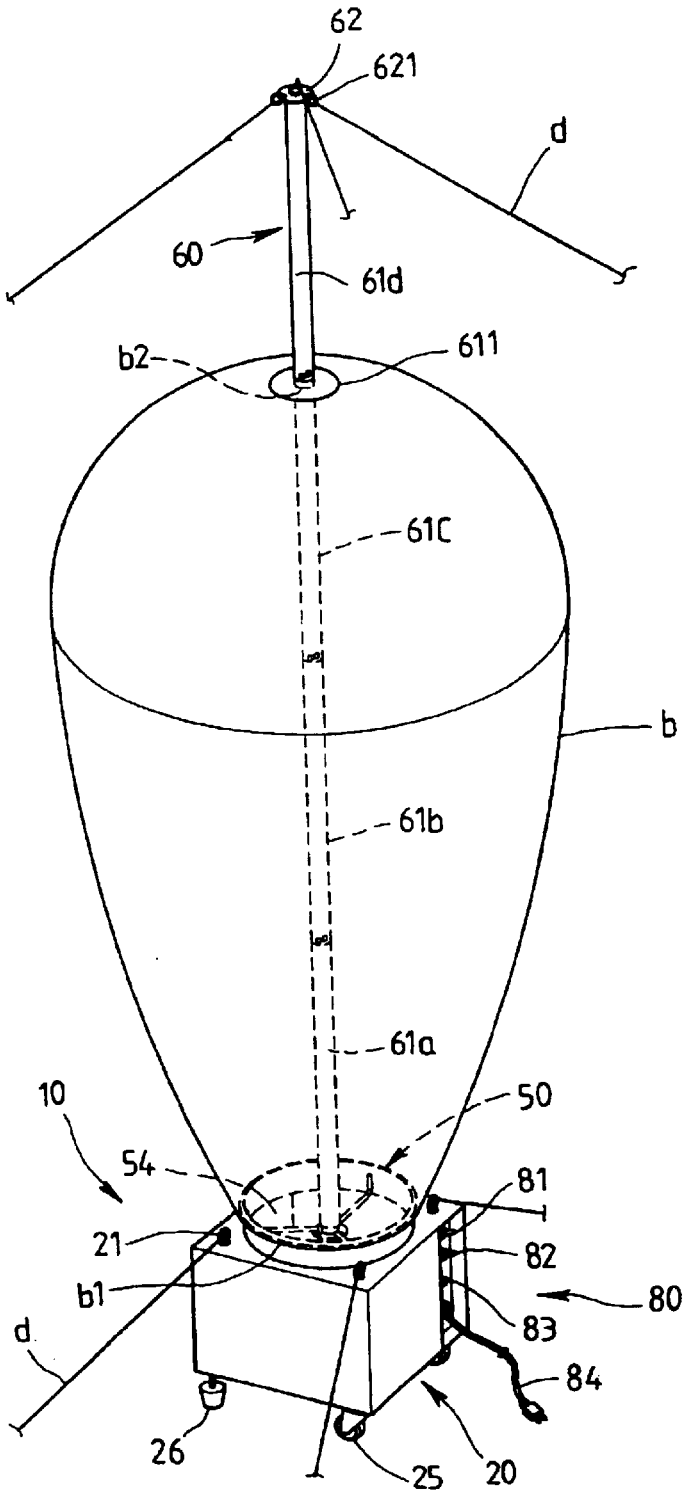
FIG. 1 is a perspective view to show the rotating inflatable device of the present invention.
Figure 2:
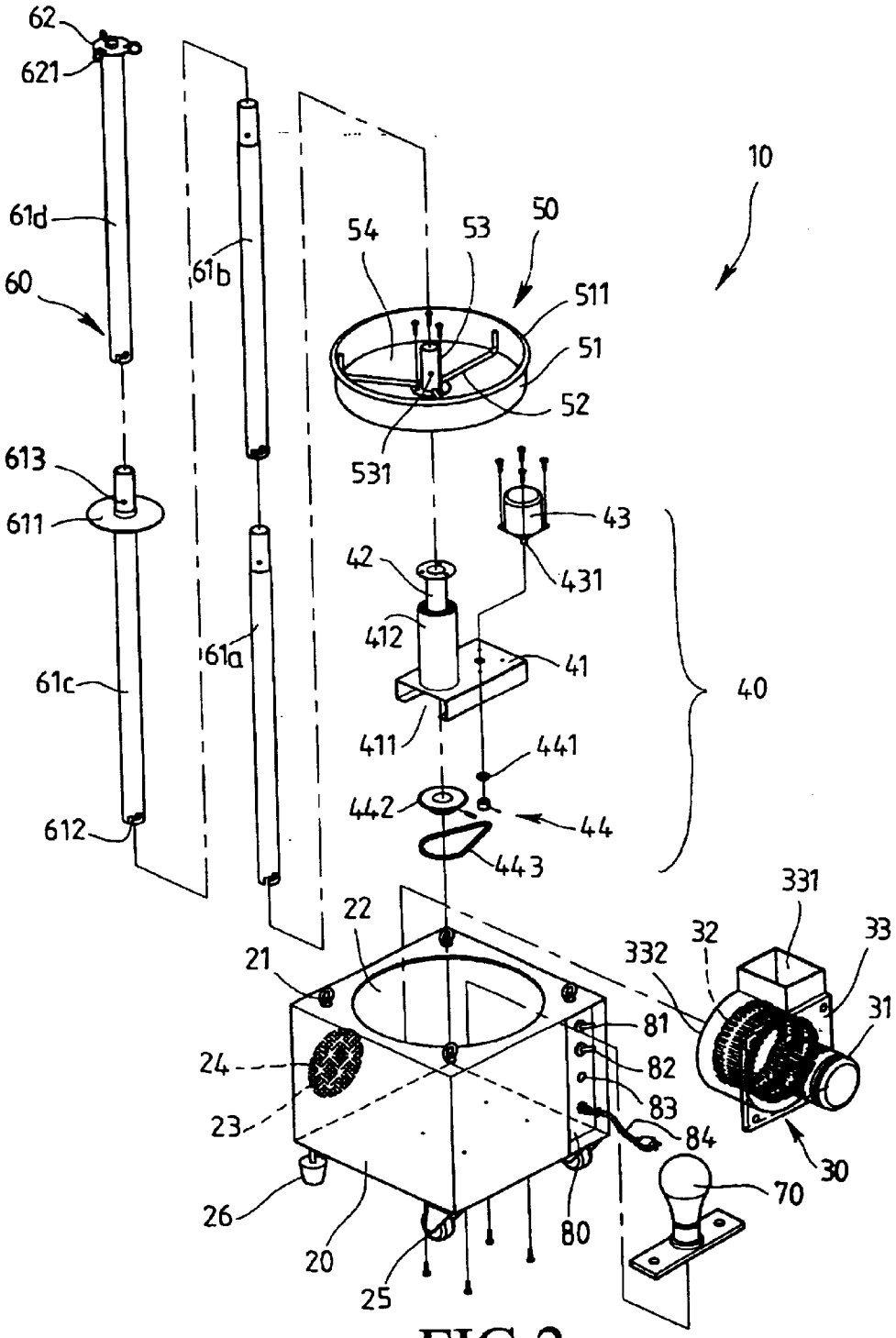
FIG. 2 is an exploded view to show the rotating inflatable device of the present invention.
Figure 3:
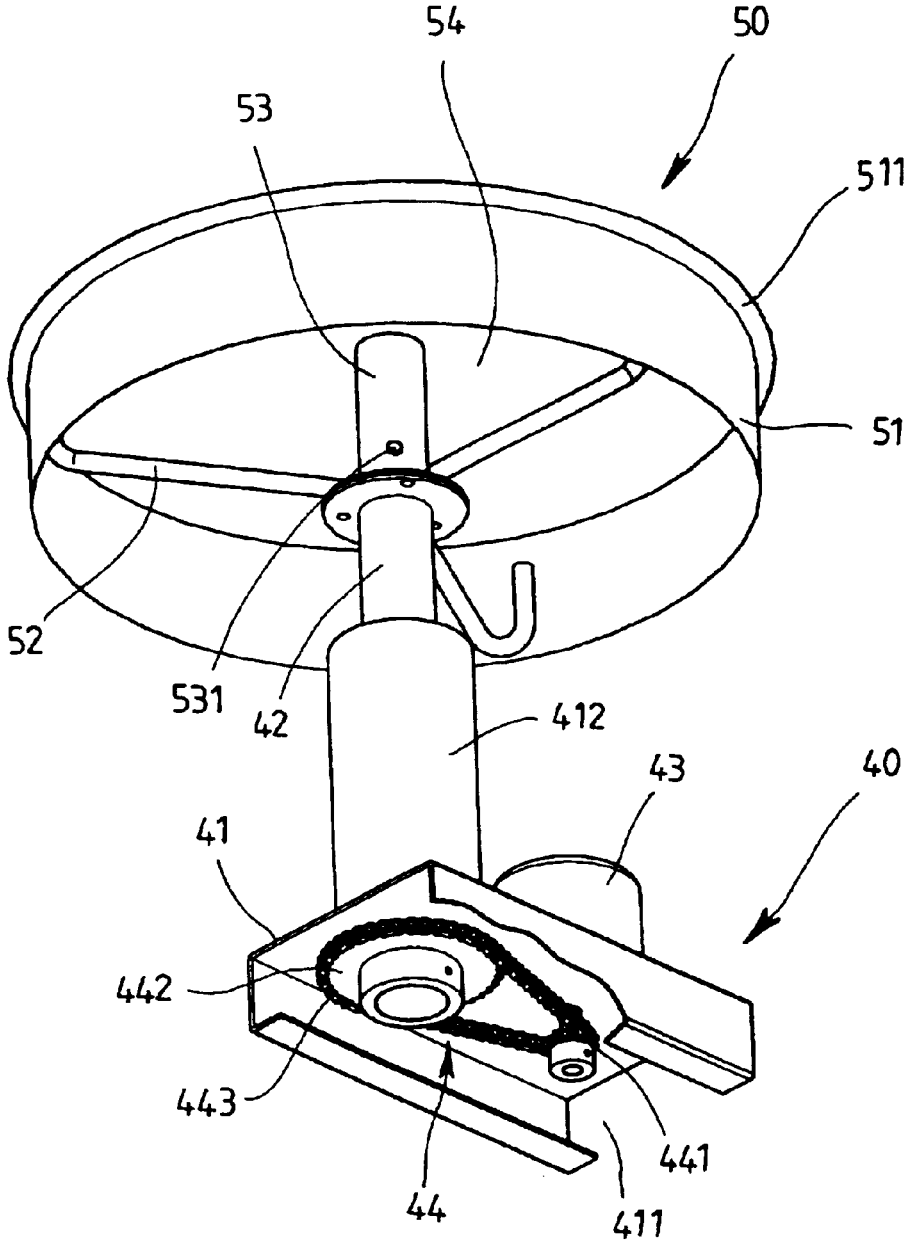
FIG. 3 is a perspective view to show the speed reduction unit and the rotating rod of the drive part.

Referring to FIGS. 1 to 3, the rotating inflatable device 10 of the present invention comprises a box-like base 20 which has an outlet 22 defined in a top thereof and an inlet 23 defined in a side of the base 20. A filter 24 is engaged with the inlet 23 of the base 20. A plurality of rings 21 are located at corners on the top of the base 20 so as to be connected with ropes "d" to fix the base 20. The base 20 further has casters 25 and fixed legs 26 connected to an underside thereof such that the base 20 can be easily moved.

A blower 30 is received in the base 20 and includes a first motor 31 and a blade part 32 which is driven by the first motor 31. The blade part 32 is received in a wind box 33 and a hole 332 is defined in a front side of the wind box 33 so as to such air into the win box 33. An opening 331 is defined in a top of the wind box 33 and in communication with the outlet 22 of the base 20.

A drive part 40 is received in the base 20 and includes a frame 41 on which a tube 412 is connected to a top of the frame 41. A rotating rod 42 rotatably extends through the tube 412 and the frame 41. A second motor 43 is connected to the frame 41 and an output shaft 431 of the second motor 43 extends through the frame 41. A speed reduction unit 44 is received in a space 411 defined in an underside of the frame 41 and includes a small active wheel 441 mounted to the output shaft 431 of the second motor 43 and a large passive wheel 442 mounted to the rotating rod 42. A chain 443 is operatively connected between the active wheel 441 and the passive wheel 442. The rotating rod 42 rotates when the second motor 43 is activated.

A drum 50 includes an annular ring 51 and a central part 53 which is located at a center of the drum 50 by a plurality of ribs 52 connected between the annular ring 51 and the central part 53. The central part 53 has a protrusion 531 on an outer periphery thereof. The annular ring 51 has a flange 511 which extends outward therefrom. A balloon "b" has a lower opening "b1" mounted to the drum 50 and a fastening ring "c" is mounted to the annular ring 51 and located below the flange 511 so as to secure the lower opening "b1" of the balloon "b" to the annular ring 51. A plurality of through holes 54 are defined between the ribs 52 so that the air can be sent into the balloon "b" through the through holes 54. A top end of the rotating rod 42 is co-axially connected to the central part 53.

A central shaft 60 is composed of a plurality of several sections 61*a*, 61*b*, 61*c* and 61*d*. Each section 61*a*/61*b*/61*c*/61*d* of the central shaft 60 has a protrusion 613 on a first end thereof and an N-shaped groove 612 defined in a second end thereof. The second end of the section 61*a* is connected to the central part 53 by engaging the protrusion 531 with the N-shaped groove 612 of the section 61*a*. The sections 61*a*/61*b*/61*c*/61*d* are connected with other by engaging the protrusions 613 with the N-shaped grooves 612. The first end of the section 61*c* of the central shaft 60 extends through a top opening "b2" of the balloon "b" and a plate 611 is mounted to the section 61*c* and seals on the top opening "b2" of the balloon "b". The first end of the section 61*d* has a disk 62 and a plurality of rings 621 are connected to the disk 62 and adapted to be connected to ropes "d" to further position the balloon "b" if needed.

Figure 4:
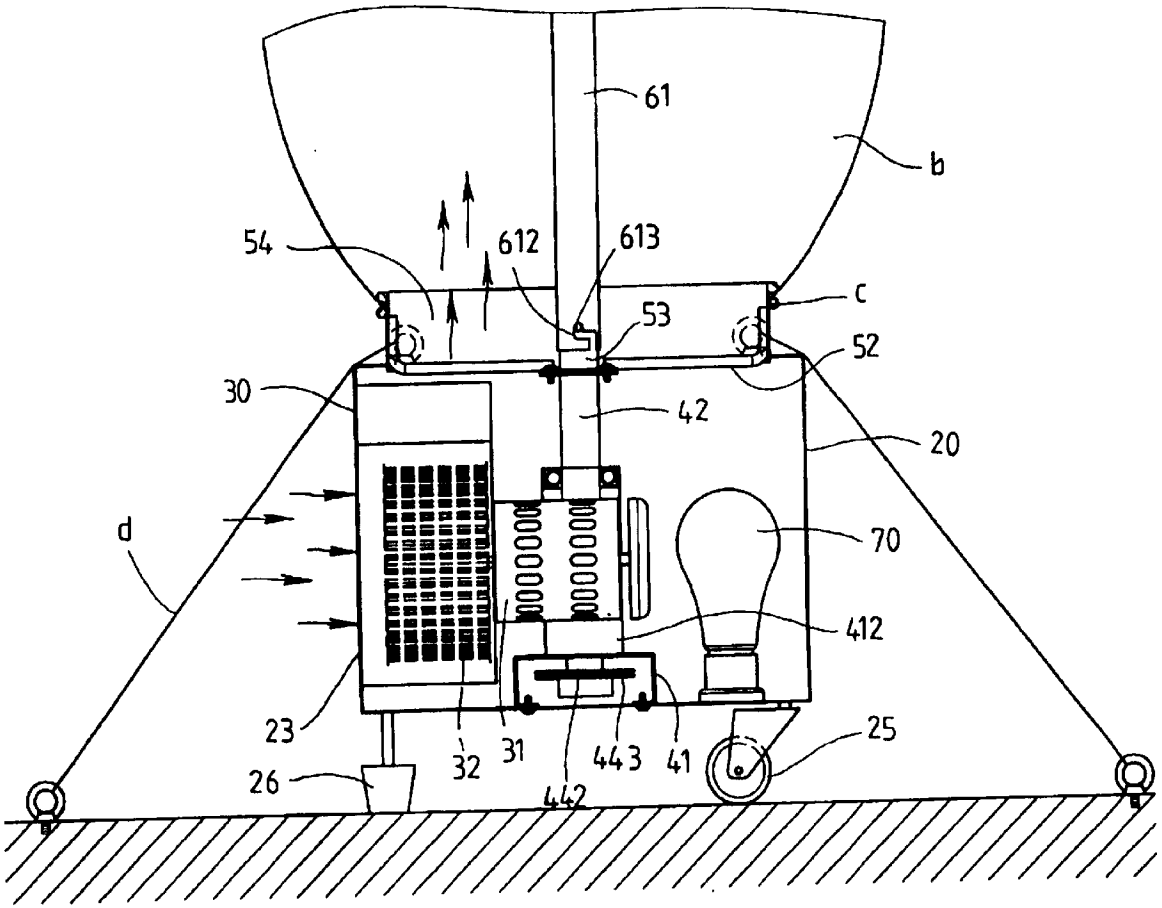
FIG. 4 shows the blower and the drive part in the base of the rotating inflatable device of the present invention.
Figure 5:
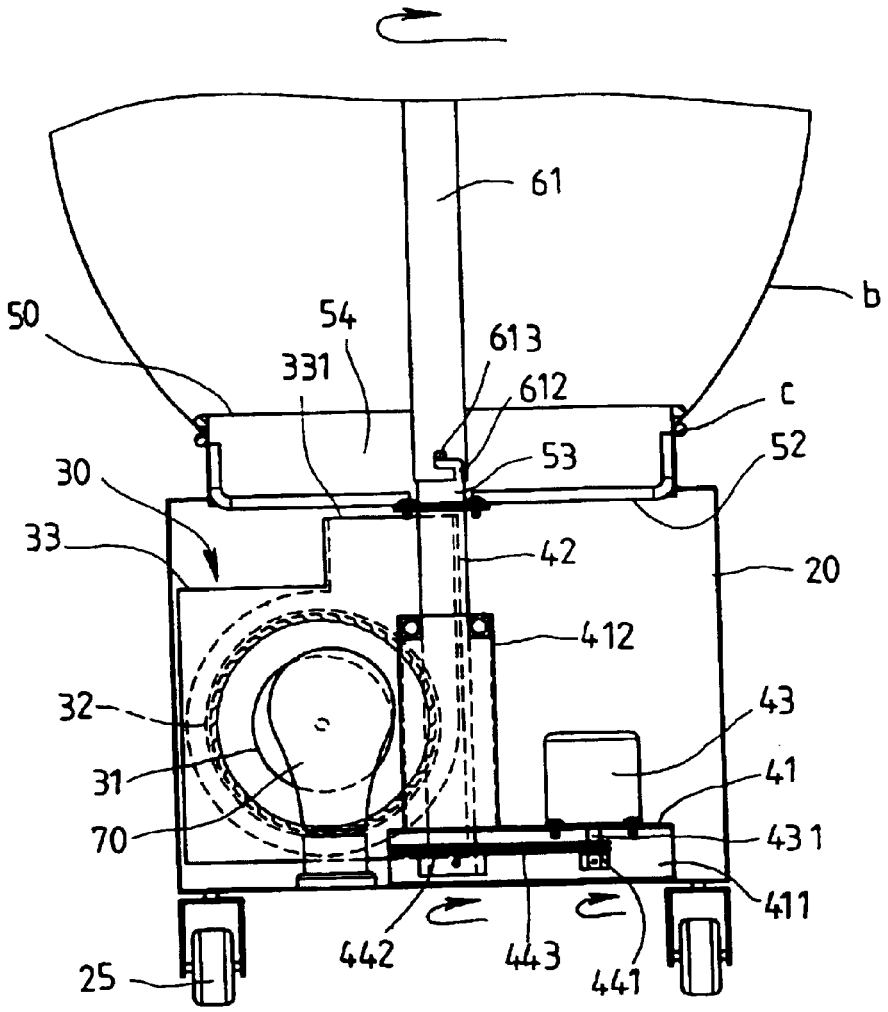
FIG. 5 shows a top view of the connection of the two pedal assemblies and the extension of the scooter of the present invention.
Figure 6:
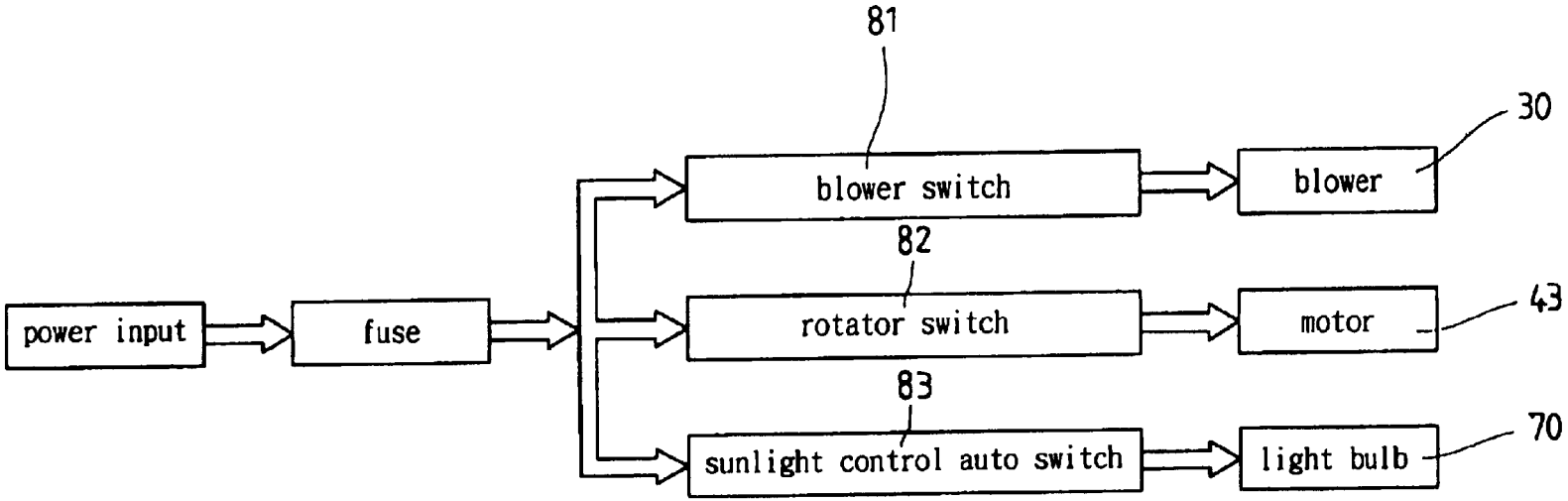
FIG. 6 shows the block diagram of the switch control system of the rotating inflatable device of the present invention.

Further referring to FIGS. 4 to 6, a control system 80 including a blower switch 81 for controlling the blower 30, a rotator switch 82 for controlling the second motor 43 and a sunlight control auto switch 83 is connected to the base 20. Each of the switches 81, 82 and 83 are powered by a power input by a wire 84. A light bulb 70 is located in the base 20 and electrically connected to the sunlight control auto switch 83 so as to illuminate the balloon "b".

The blower 80, the drive part 40 and the light bulb 70 are received in the base 20 so that they are well protected by the base 20 and easily to be transported. The rotating rod 42 is co-axially connected to the central shaft 60 so that the drum 50 and the balloon "b" are rotated in balance. The central shaft 60, the drum 50 and the balloon "b" are rotated, no stationary part is in contact with the rotating parts so that no noise or friction is generated.

While we have shown and described the embodiment in accordance with the present invention, it should be clear to those skilled in the art that further embodiments may be made without departing from the scope of the present invention.

What is claimed is:

1. A rotating inflatable device comprising:

a base having an outlet defined in a top thereof and an inlet defined in a side of the base;

a blower received in the base and including a first motor and a blade part which is driven by the first motor, the blade part received in a wind box and an opening defined in a top of the wind box;

a drive part received in the base and including a frame through which a rotating rod rotatably extends, a second motor connected to the frame and an output shaft of the second motor extending through the frame, a speed reduction unit located at an underside of the frame so as to connect the output shaft of the second motor to the rotating rod;

a drum including an annular ring and a central part located at a center of the drum by a plurality of ribs connected between the annular ring and the central part, a top end of the rotating rod co-axially connected to the central part;

a balloon having a lower opening mounted to the drum; and a central shaft composed of a plurality of sections and a lower end of the central shaft connected to the central part, a top end of the central shaft extending through a top opening of the balloon and connected to a plate which seals on the top opening of the balloon.

2. The device as claimed in claim 1, wherein the base has a plurality of rings which are adapted to be connected with ropes.

3. The device as claimed in claim 1, wherein the base has casters and fixed legs connected to an underside thereof.

4. The device as claimed in claim 1, wherein a filter is engaged with the inlet of the base.

5. The device as claimed in claim 1, wherein a blower switch for controlling the blower, a rotator switch for controlling the second motor and a sunlight control auto switch are connected to the base, a light bulb located in the base and electrically connected to the sunlight control auto switch.

6. The device as claimed in claim 1, wherein the frame includes a space defined in the underside thereof and the speed reduction unit is received in the space.

7. The device as claimed in claim 1, wherein the speed reduction unit includes a small active wheel mounted to the output shaft of the second motor and a large passive wheel mounted to the rotating rod, a chain operatively connected between the active wheel and the passive wheel.

8. The device as claimed in claim 1, wherein the annular ring has a flange which extends outward therefrom and a fastening ring mounted to the annular ring and located below the flange so as to secure the lower opening of the balloon to the annular ring.

9. The device as claimed in claim 1, wherein the central part has a protrusion, each section of the central shaft has a protrusion on a first end thereof and an N-shaped groove defined in a second end thereof, the protrusion on the central part engaged with the N-shaped groove in one of the sections of the central shaft, the sections being connected with other by engaging the protrusions with the N-shaped grooves.

10. The device as claimed in claim 1, wherein a top section is connected to the top end of the central shaft and a disk is connected to a top of the top section, a plurality of rings connected to the disk and being adapted to be connected to ropes.

* * * * *